United States Patent [19]

Eheim et al.

[11] Patent Number: 4,491,111

[45] Date of Patent: Jan. 1, 1985

[54] FUEL INJECTION APPARATUS FOR INTERNAL COMBUSTION ENGINES

[75] Inventors: Franz Eheim, Stuttgart; Wilfried Böhringer, Flein, both of Fed. Rep. of Germany

[73] Assignee: Robert Bosch GmbH, Stuttgart, Fed. Rep. of Germany

[21] Appl. No.: 408,977

[22] Filed: Aug. 17, 1982

[30] Foreign Application Priority Data

Nov. 7, 1981 [DE] Fed. Rep. of Germany ..... 3144361

[51] Int. Cl.[3] ..... F02M 59/42

[52] U.S. Cl. ..... 123/449; 123/458; 123/460; 123/506; 137/614.21

[58] Field of Search ..... 123/449, 458, 460, 506; 137/614.2, 614.21

[56] References Cited

U.S. PATENT DOCUMENTS

| | | | |
|---|---|---|---|
| 2,969,088 | 1/1961 | Kramer | 137/614.21 |
| 3,183,932 | 5/1965 | Karpus, Jr. | 137/614.21 |
| 3,538,951 | 11/1970 | Bownass | 137/614.21 |
| 3,724,436 | 4/1973 | Nagata et al. | 123/478 |
| 4,023,586 | 5/1977 | Nemetz et al. | 137/614.2 |
| 4,073,277 | 2/1978 | Eheim | 417/505 |
| 4,385,614 | 5/1983 | Eheim et al. | 123/506 |

*Primary Examiner*—Magdalen Y. C. Moy

*Attorney, Agent, or Firm*—Edwin E. Greigg

[57] ABSTRACT

A fuel injection apparatus for supplying fuel to an internal combustion engine is proposed. The fuel injection apparatus includes a pump work chamber enclosed within a pump housing, which work chamber is defined at one end by an axially displaceable and rotatable pump piston. The pump work chamber can be made to communicate, during the intake stroke of the pump piston, with a fuel inlet conduit via an electromagnetically actuatable metering valve and a check valve. The metering valve and check valve are combined into a common valve housing and are disposed in the immediate vicinity of the pump work chamber.

1 Claim, 5 Drawing Figures

FUEL INJECTION APPARATUS FOR INTERNAL COMBUSTION ENGINES

BACKGROUND OF THE INVENTION

The invention is based on a fuel injection apparatus for internal combustion engines having at least one pump work chamber enclosed in a pump housing by a pump piston, wherein the pump work chamber can be made to communciate via at least one supply line with a fuel injection location and, during the intake stroke of the pump piston, can be made to communicate at least intermittently, by means of an electromagnetically actuatable metering valve via a check valve opening in the direction of the pump work chamber, with a fuel inlet conduit leading to a fuel supply source. A fuel injection apparatus is already known, but in which the electromagnetically actuatable metering valve and the check valve are disposed spaced apart from one other, so that not only is the expense of assembly increased, but an undesirably large clearance volume also exists between the two valves.

OBJECT AND SUMMARY OF THE INVENTION

The fuel injection apparatus according to the invention revealed hereinafter has the advantage over the prior art of low expense for assembling it and minimal clearance volume between the electromagnetically actuatable metering valve and the check valve.

The application discloses advantageous further embodiments of and improvements to the fuel injection apparatus as disclosed herein and finally claimed.

The invention will be better understood and further objects and advantages thereof will become more apparent from the ensuing detailed description of preferred embodiments taken in conjunction with the drawings.

Figure 3:
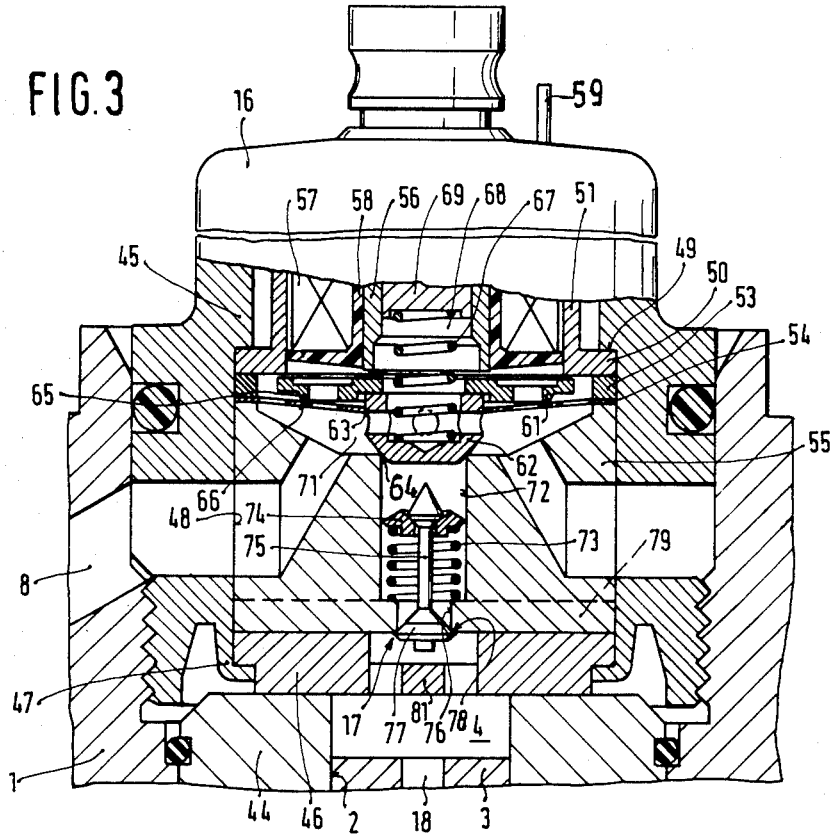
Figure 4:
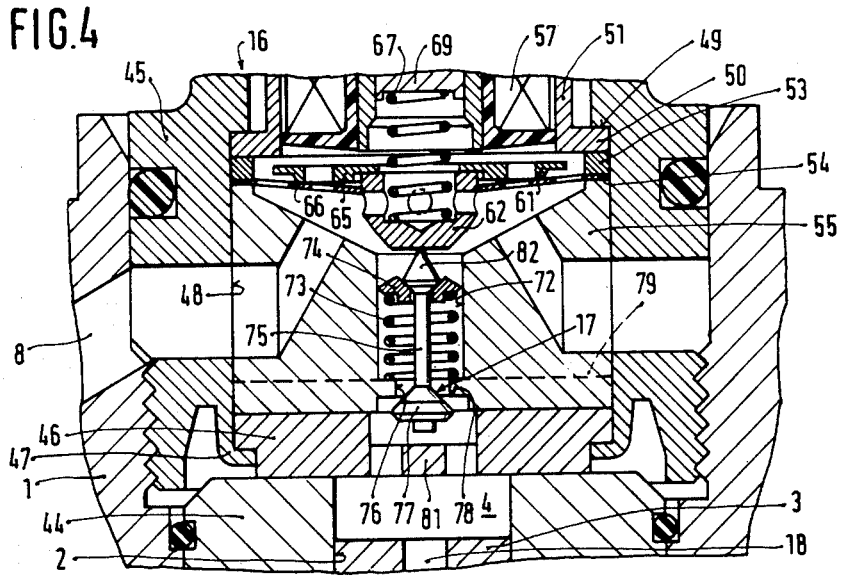

FIG. *2a* a diagram in which the switching time of the electromagnetically actuatable metering valve is plotted over the rotary angle of the pump piston;

FIG. *2b* shows the course of the stroke of the pump piston with respect to the rotary angle of the pump piston;

FIG. 3 shows a fragmentary cross-sectional view of a first exemplary embodiment of the invention having a check valve integrated with an electromagnetically actuatable metering valve; and FIG. 4 is another fragmentary cross-sectional view of a second exemplary embodiment of the invention having a check valve integrated with an electromagnetically actuatable metering valve.

DESCRIPTION OF THE EXEMPLARY EMBODIMENTS

Figure 1:
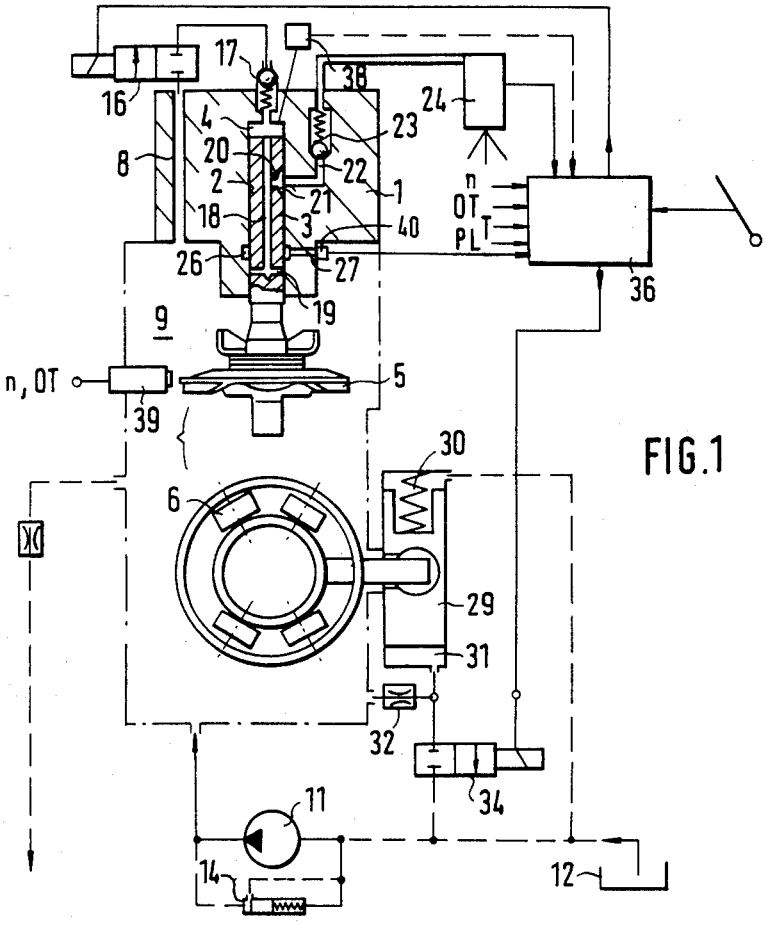
FIG. 1 is a basic schematic illustration of a fuel injection apparatus.
Figure 2A:
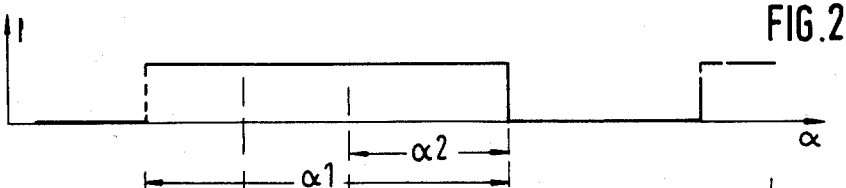
Figure 2B:
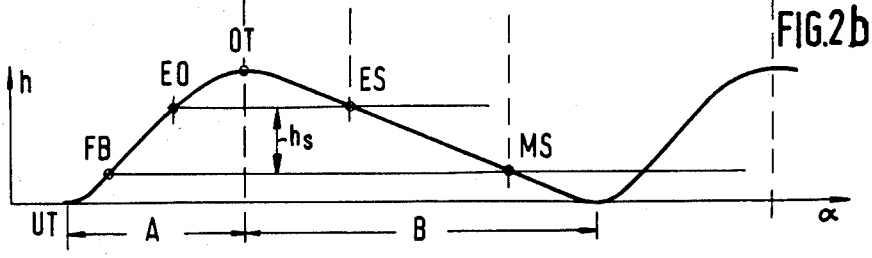

In the basic illustration of a fuel injection pump in FIG. 1, a cylinder bore 2 is provided in a pump housing 1 and a pump piston 3 encloses a pump work chamber 4 within this cylinder bore 2. The pump piston 3 is driven by means not shown in further detail via a cam disk 5, which travels on a roller ring 6. Upon its rotary movement, the piston 3 executes a reciprocating pumping movement comprising in sequence an intake stroke and a supply stroke. The supply of fuel to the pump work chamber 4 is effected via a fuel inlet conduit 8, which leads to a pump suction chamber 9 shown in dot-dash lines. This pump suction chamber 9 is supplied with fuel from a fuel container 12 by means of a fuel supply pump, and the pressure in the pump suction chamber 9 is adjusted with the aid of a pressure regulation valve 14 which is disposed parallel to the fuel supply pump 11.

An electromagnetically actuatable metering valve 16, acting as a fuel quantity metering device, is inserted into the fuel inlet conduit 8. Downstream of this metering valve 16 there is also a check valve 17 opening in the direction toward the pump work chamber 4. A blind bore 18 disposed in the pump piston 3 leads away from the pump work chamber 4, and a radial bore 19 leads to the outside from this blind bore 18. A further radial bore 20 connects the blind bore 18 with a distributor groove 21, through which supply lines 22 are connected one after the other with the pump work chamber 4 in the course of the rotation and supply stroke of the pump piston 3. The supply lines 22 are distributed, in accordance with the number of cylinders of the engine (not shown) to be supplied, on the circumference of the cylinder bore 2; each supply line 22 contains one relief valve 23, by way of which each supply line is connected with one injection valve 24. An annular groove 26 is further provided in the wall of the cylinder bore 2, annd the annular groove 26 communicates via at least one bore 27 with the pump suction chamber 9. The annular groove 26 is disposed such that the radial bore 19 in the pump piston 3 is opened up beyond a maximum supply stroke, so that the fuel supplied beyond this point during the course of the remaining stroke of the pump piston 3 is capable of flowing out onto the pump suction chamber 9 via the blind bore 18 acting as a relief conduit, the radial bore 19 and the bore 17, and the supply of pressure into the supply line 22 is thereby interrupted.

In order to vary the instant of injection, an injection adjusting piston 29 is further provided, which is coupled with the roller ring 6 and adjustable counter to the force of a spring 30. The injection adjusting piston 29 encloses a pressure chamber 31, which communicates via a throttle 32 with the pump suction chamber 9 and is thus exposed to an rpm-dependent pressure in the pump suction chamber 9. In accordance with this rpm-dependent pressure and with the aid of the injection adjusting piston 29, the instant of injection is adjusted toward "early" with increasing rpm by rotating the roller ring 6. In order to influence the instant of injection, the pressure chamber 31 is further connected via a magnetic valve 34 with the intake side of the fuel supply pump 11 and can be relieved with the aid of this magnetic valve 34. The magnetic valve 34 is controlled by an electronic control unit 36, which further serves also to control the electromagnetically actuatable metering valve 16 in the fuel inlet conduit 8. The control unit 36 functions in accordance with parameters of significance in the measurement and time control of the fuel injection quantity. For instance, the control unit 36 may contain at least one performance graph, in which setpoint values for the quantity of fuel to be injected are contained in either indirect or direct form. In a manner known per se, these parameters may be the rpm n, the temperature T, the air pressure $P_L$ and the load. In a manner especially intended for triggering the metering valve 16, signals from a needle stroke transducer in the injection valve can also be ascertained, as further parameters, for ascertaining the actual onset of injection and the actual fuel injection duration. Alternatively, however, it is also possible, via a pressure transducer 38, which is disposed in some suitable manner on the high-pressure side of the fuel injection pump, to use control signals for ascertaining the onset or duration of supply. In order to ascertain the stroke position of the pump piston and/or its rpm n, a transducer 39 may be provided, for instance in the form of an inductive transducer on the cam disk 5.

The mode of operation of the fuel injection apparatus shown in FIG. 1 will now be explained, referring to the diagram in FIGS. *2a* and *2b*. FIG. *2b* shows the course of the stroke h of the pump piston 3 plotted over the rotary angle $\alpha$. By means of an appropriate realization of the cam disk 5, it is hereby attained that the stroke variation per rotary angle $\alpha$ during the compression or supply stroke of the pump piston 3 is substantially greater than the stroke variation during the intake stroke of the pump piston. This part B of the test curve has a very flat course and is linear except for the border zone at the points of reversal of the pump piston 3. The compression stroke part A of the test curve in FIG. *2b* is divided into three segments. Between bottom dead center UT of the pump piston 3 at the onset of the compression stroke and the point FB, the fuel located in the pump work chamber 4 is compressed, until the supply pressure which effects an opening of the injection valve 24 has been attained. The second part of the test curve extends between points FB and EO. In this range, fuel is pumped into the supply line 22. By means of the supply pressure, the check valve 17 is closed, this action being reinforced if needed by the spring installed there. The electromagnetically actuatable metering valve 16 is thus pressure-relieved.

Upon attaining point EO of the test curve, the radial bore 19 is brought into communication with the annular groove 26, so that the pump work chamber 4 is relieved in favor of the pump suction chamber 9. The remaining fuel quantity to be positively displaced flows out toward the suction chamber 9. This is effected in the range between the opening EO of the radial bore 19 and top dead center OT of the pump piston 3. The metering valve 16 is opened, at the latest, upon the attainment of top dead center OT. The opening may be effected earlier as well, because during the compression stroke the fuel inlet conduit 8 is closed by the check valve 17. In the range between top dead center OT and the closing point ES of the radial bore 19, fuel is aspirated via the large opening cross section of the fuel metering valve 16. In the range between EO and ES, it is assured that the pump work chamber is equalized in pressure, continuously refilled and flushed. Beyond ES, the effective intake stroke of the pump piston 3 begins, during which fuel is aspirated until the closure of the metering valve 16 at MS. The effective intake stroke length $h_s$ is thus determined first by the geometric embodiment of the fuel injection pump, or by the position of the control edge defining the annular groove 26, and secondly by the switching time of the metering valve 16. In FIG. *2a*, the switching times of the metering valve 16 are shown when triggering is effected at a current intensity I; $\alpha_1$ indicates the total opening time of the metering valve, while $\alpha_2$ represents the time which is effective for the metering.

Since the metering valve 16 can already be opened well before the onset of the actual effective intake stroke $h_s$, and a flushing phase is located (EO-ES) between the effective supply stroke and the effective intake stroke of the pump piston 3, no further consideration has to be taken of the instant of injection within the possible adjustment range for the instant of injection upon the opening of the metering valve 16.

By fixing the effective intake stroke length, very good precision on the part of the fuel quantity to be metered is attained. In the simplest case, the effective intake stroke length for the metering can be controlled directly, without requiring a feedback of the actual fuel quantity injected. Very good control results are obtained if the actual fuel injection quantity is ascertained in a manner known per se by means of the control unit 36 and compared in a comparison device of the control unit with a set-point fuel quantity signal formed therein. The actual fuel quantity, as noted at the outset, may be ascertained by means of a needle stroke transducer or by an appropriately evaluated pressure signal of the pressure transducer 38. The set-point fuel quantity is formed based on the parameters listed earlier, with the load as the guide variable. The actual opening time of the metering valve 16 is then corrected in accordance with the result of comparison, in the event that the actual fuel quantity deviates from the set-point value. The basic opening duration signal of the metering valve 16 is formed in accordance with the set-point fuel quantity signal.

In order to ascertain the test point ES at which the radial bore 19 is again closed, a pressure-sensing transducer 40 is provided at the bore 27, its signal being fed to the control unit 36. An integrating device in the control unit 36 is set with the signal of the transducer 40 characterizing the point ES, and as soon as the output value of the integrating device has attained the set-point value for the fuel quantity provided by the control unit 36, a switching signal is sent by a comparison device for both values to the metering valve 16 in order to close the fuel inlet conduit 8. In order that the switching time of the metering valve 16 will be dependent purely on the stroke length, the running time of the integrator must be corrected upon integration by means of an integration time constant adapted to the rpm. This may be accomplished using known methods, either by designing the integrator itself such that it is rpm-dependent in analog fashion, or by providing that the integrator performs integration in constant increments with an rpm-dependent frequency.

In another embodiment, it is also possible for a correction signal to be generated from an OT signal, which is attained with the aid of the transducer 39, and the signal emitted by the transducer 40; this correction signal then corrects the opening phase of the metering valve 16, which is switched in synchronism with rpm.

In FIG. 3, a partial view is shown of a fuel injection pump embodied in accordance with the schematic illustration of FIG. 1. Elements having the same function are given identical reference numerals in both figures. A cylinder bushing 44 is fitted into the pump housing 1, and the cylinder bore 2 is embodied in this cylinder bushing 44, in which the pump piston 3 is also slidably disposed. The electromagnetically actuatable metering valve 16 is inserted into the pump housing 1, being screwed into place, for example, and an end plate 46 at least partially surrounds and engages its valve housing 45 with tabs 47. The end plate 46 rests in a sealing manner against the cylinder bushing 44 and in the axial direction defines the pump work chamber 4 on one side. The valve housing 45 is cup-shaped in embodiment and in an inner bore 48 supports a collar 50 of an outer core 51 on an inner step 49 of the valve housing 45. Between the collar 50 and the end plate 46, a spacer ring 53, a guide diaphragm 54 and a valve seat body 55 are fastened in the axial direction in the inner bore 48. The outer core 51 is connected in a manner not shown, via a yoke, with an annular inner core 56. A magnetic coil 57 is at least partially enclosed by an insulating carrier body 58, which is inserted with the magnetic coil 57 into the annular chamber formed between the outer core 51 and the inner core 56. The supply of current to the magnetic coil is effected via contact pins 59, by way of example, only one of which is shown. A flat armature 61 is disposed between the end faces of the outer core 51 and inner core 56 and the guide diaphragm 54. In the central part of the flat armature 61, a movable valve element 62 is connected with the flat armature, being soldered or welded, for example. The valve element 62 passes through a central guide opening 63 in the guide diaphragm 54 and cooperates with a fixed valve seat 64 embodied on the valve seat body 55. The valve element 62 and the flat armature 61 are guided by the central guide opening 63 of the guide diaphragm 54 in an axial direction toward the valve seat 64 on the one hand and on the other hand toward the end face of the outer core 51 and of the inner core 56. There is no rigid connection between either the guide diaphragm 54 and the valve element 62 or the guide diaphragm 54 and the flat armature 61. The flat armature 61 has an annular guide ring 65 oriented toward the guide diaphragm 54, and a guide edge 66 which rests on the guide diaphragm 54 is embodied on this guide ring 65; as a result, the flat armature 61 is guided in a parallel plane relative to the end face of the outer core 51 and the inner core 56.

The valve element 62 has a section which is conical in shape, by way of example, perhaps embodied as a flattened spherical zone, cooperating with the valve seat 64. When the valve element 62 is resting on the valve seat 64, the guide diaphragm 54 is curved under the tension and rests on the guide edge 66 of the flat armature. The valve element 62 is urged in the closing direction of the metering valve by a compression spring 67, which at the other end protrudes into an inner bore 68 of the inner core 56 and is supported on a slide member 69. The force of the compression spring 67 on the flat armature 61 and the valve element 62 can be varied by means of the axial displacement of the slide member 69.

The chamber 71 formed upstream of the valve seat 64 and having the movable valve element 62 passing through it communicates with the fuel inlet conduit 8. In the excited state of the magnetic coil 57, the flat armature 61 is attracted, and the valve element 62 rises from the valve seat 64, so that fuel can flow out of the chamber 71 into a reception bore 72 embodied in the valve seat body 55. A restoring spring 73 is disposed in this reception bore 72 and is supported via a spring plate 74 on a valve needle 75 of the check valve 17. The valve needle 75 passes through a bore 76, adjacent to the reception bore 72, of the valve seat body 55 and rests with a conical sealing element 77 on a valve seat 78 formed on the valve seat body 55. As suggested by dashed lines, the bore 76 and the valve seat 78 could equally well be embodied in a valve seat plate 79, which is fastened in place between the valve seat body 55 and the end plate 46. The opening movement of the valve needle 75 of the check valve 17 toward the pump work chamber 4 is limited by a stop 81 in the end plate 46. The integration of the check valve 17 with the metering valve 16 not only reduces the amount of space required, but also permits mounting both valves in common in the pump housing, with the least possible clearance volume.

In the exemplary embodiment shown in FIG. 4, elements having the same function as those described earlier in connection with the foregoing figures are identified by the same reference numerals. Differing from the exemplary embodiment shown in FIG. 3, the element 62 of FIG. 4, which is connected with the flat armature 61, does not serve as a movable valve element but instead is brought into contact with a head 82 of the valve needle 75, when the magnetic coil 57 is in the unexcited state, by means of the compression spring 67; the purpose is to displace this valve needle 75 into the open position, counter to the force of the restoring spring 73, so that the sealing element 77 moves away from the valve seat 78. The valve needle 75 thus serves as the movable valve element of both the metering valve 16 and the check valve 17 simultaneously. The metering valve 16 and the check valve 17 thus also have the same valve seat 78. In the excited state of the magnetic coil 57, the flat armature 61 is drawn toward the outer core 51 and the inner core 56, and the element 62 rises from the valve needle 75, so that the restoring spring 73 displaces the valve needle 75 into the closing position of the metering valve 16 or of the check valve 17. A particular advantage of this exemplary embodiment is the further decrease in the installation space required and in the expense of assembly, with the resultant cost advantage attained by embodying the metering valve 16 and check valve 17 with only one movable valve element and one valve seat. It is also advantageous, in both exemplary embodiments, that the metering valve 16 and check valve 17 are disposed in the immediate vicinity of the pump work chamber 4.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is.

1. A fuel injection apparatus for internal combustion engines comprising a pump housing having at least one pump work chamber enclosed by an end plate and a pump piston movable in a bore in a bushing along a longitudinal axis of said housing, said pump work chamber being in communication via at least one fuel supply line with a fuel injection location, and during a stroke of said pump piston said pump work chamber communicating at least intermittently with a fuel inlet conduit that leads to a fuel supply source, a valve housing in said pump housing, a valve seat body in said valve housing, said valve seat body directly abuts an end face of said end plate which abuts an end face of said bushing in which said pump piston is disposed to minimize a dead volume of fuel contained in said work chamber, an axially aligned bore in said valve seat body, a first valve seat at one end of said axially aligned bore and a second valve seat at another end of said axially aligned bore, an electromagnetically actuatable metering valve disposed in said valve housing, said metering valve having an armature and a movable valve element secured thereto coacting with said first valve seat disposed at one end of said axially aligned bore in said valve seat body, said axially aligned bore extending through said valve seat body in a direction of the pump piston and terminating at its opposite end in said second valve seat, upon excitation of said electromagnet said movable valve element being lifted from said first valve seat to open said axially aligned bore to fuel flow, and a check valve coacting with said second valve seat to allow fuel flow through said axially aligned bore only in the direction to said pump work chamber, and spring biasing means supported within said axially aligned bore biasing said check valve into bore closing engagement with said second valve seat.

* * * * *